United States Patent [19]

Ehmann et al.

[11] 4,005,598

[45] Feb. 1, 1977

[54] PNEUMATIC BLIND RIVETER WITH CASCADED PISTONS

[75] Inventors: Hans Ehmann, Frankfurt am Main; Günther Klein, Walldorf, Hessen, both of Germany

[73] Assignee: GESIPA Blindniettechnik Gesellschaft mit beschrankter Haftung, Frankfurt am Main, Germany

[22] Filed: May 23, 1975

[21] Appl. No.: 580,328

[30] Foreign Application Priority Data

May 25, 1974 Germany ..... 2425385
May 25, 1974 Germany ..... 7418183[U]

[52] U.S. Cl. ..... 72/391; 72/453.19; 91/411 A; 91/461

[51] Int. Cl.² ..... B21J 15/34

[58] Field of Search ..... 72/391, 114, 453, 450; 91/461, 304, 411 A; 173/169

[56] References Cited

UNITED STATES PATENTS

| | | | |
|---|---|---|---|
| 2,053,717 | 9/1936 | Huck | 72/450 |
| 2,396,001 | 3/1946 | Fischer | 72/391 |
| 3,084,672 | 4/1963 | Dalton | 91/461 |
| 3,402,778 | 9/1968 | Carter | 91/411 A |
| 3,430,539 | 3/1969 | Freeman | 91/411 A |
| 3,451,248 | 6/1969 | Bell | 72/391 |
| 3,457,763 | 7/1969 | Freeman | 72/391 |
| 3,485,141 | 12/1969 | Ott | 91/411 A |
| 3,554,088 | 1/1971 | Bruyn | 91/411 A |
| 3,630,427 | 12/1971 | Stokes | 72/391 |
| 3,802,519 | 4/1974 | Newton | 173/169 |

*Primary Examiner*—C.W. Lanham
*Assistant Examiner*—Gene P. Crosby
*Attorney, Agent, or Firm*—Ernest G. Montague; Karl F. Ross; Herbert Dubno

[57] ABSTRACT

A blind riveter has a housing with a tubular body and a nosepiece containing a rivet-mandrel-gripping chuck extending transverse to this body. The body is provided with three in-line tubes constituting a liner separated by two partitions so as to form three compartments each provided with a respective longitudinally reciprocal piston. A stem interconnects the three pistons and is provided at the forward end with an end piece engaging a roller on the long arm of a bell-crank lever pivoted on the housing and having a short arm pivoted on a puller body carrying the rivet-gripping chuck. A collar on the rear end of the housing is provided with a control valve that pressurizes all three of the chambers in back of the pistons while pressurizing the extreme rear chamber and the other two chambers through a passage formed through the same interconnecting pistons, and can pressurize the chamber in front of the rear piston so as to retract all three pistons depending on the position of a trigger constituting a pilot valve controlling the position of a spool valve.

17 Claims, 7 Drawing Figures

PNEUMATIC BLIND RIVETER WITH CASCADED PISTONS

FIELD OF THE INVENTION

This invention relates to a blind riveter. More particularly this invention concerns a pneumatically powered heavy-duty blind riveter.

BACKGROUND OF THE INVENTION

A blind riveter (see U.S. Pat. No. 2,396,001) typically comprises a housing provided with a chuck that grips the mandrel of the blind rivet and with means for pulling this chuck back away from an orifice on the housing so as to retract the mandrel in the rivet and thereby upset the rivet end. The chuck is usually of the automatic one-way gripping type and is urged by a spring to a rest position normally adjacent the orifice.

The actuator for this chuck can be pneumatically powered. In order to obtain the necessary force a large-diameter piston is used which is provided with an endpiece that in some pneumatically powered riveters is directly connected with a wedge slidable along rollers. To both sides of this wedge there is provided an arm pivoted on the housing and these arms are connected at the forward section with a transverse rod on which a roller is mounted. The roller lies on the inclined side of the wedge and the front ends of the arms are engaged in recesses in a puller body connected to the chuck. This chuck in the corresponding portion of the housing lies at a right angle to the rest of the housing so that when the actuation wedge is displaced forwardly by the piston the roller engaging the wedge is moved upwardly to lever up the chuck.

The disadvantage of this system is that it is necessary that the relatively complicated actuation device be made to very exact tolerances in order to function properly, thereby making the pneumatic rivet setter a very expensive tool. In addition the device is relatively bulky and hard to use. Therefore the operator tires readily and must often assume an uncomfortable position in order to position the riveter properly over the workpiece.

Another type of device is known which uses a plurality of pneumatic cylinders. The common piston rod for the several pistons is connected directly to the pulling chuck so that the relatively lengthy assembly can be positioned in line with the mandrel at a right angle to the workpiece. Such a position is not only uncomfortable but is often impossible so that such devices have not met with widespread acceptance. In addition the use of several pistons often means that the reset time for the tool is relatively long, as the conventional reset spring is only slowly effective to drive the air out of the compartments in back of all of the pistons.

OBJECTS OF THE INVENTION

It is therefore an object of the present invention to provide an improved blind riveter.

Another object is the provision of a pneumatically powered blind riveter that is relatively easy to hold and use, and which is of small dimensions.

Another object is to provide a blind riveter which is inexpensive to manufacture.

SUMMARY OF THE INVENTION

These objects are attained according to the present invention in a blind riveter wherein the housing is provided with a pneumatic piston whose front end is engageable with the long arm of a two-arm first-class lever whose short arm is operatively engaged with the chuck. In this manner it is possible for the housing to have an easy-to-grip handle containing the pneumatic actuating cylinder and, transverse to this handle, a nose housing the chuck. The lever connection between the actuating mechanism and the chuck therefore form a comfortable-to-hold assembly.

According to another feature of this invention the elongated chamber formed by the housing is subdivided by at least one partition into a plurality of compartments each of which is provided with a respective piston. The pistons are longitudinally aligned and interconnected by a stem. Thus the overall diameter of the housing can be reduced considerably, again making the device much easier to hold, while in no way sacrificing power as the aggregate piston surface area is sufficient, along with the mechanical advantage of the lever, for use of the riveter on virtually any size of rivet.

According to yet another feature of this invention the housing is provided with three such pistons and with a liner formed by three cylindrical tube sections clamped on opposite sides of two partitions. The piston are interconnected by a stem formed of two cylindrical tubes having ends braced against the bases of the pistons and a core rod of noncircular section passing through the two tubes and secured at its two ends via endpieces to the pistons. The two tubes are formed at their extreme front ends with notches and the rear endpiece is formed at its front face with a similar notch so that fluid communication is possible through the passage formed between the noncircular core and the tubes, this passage opening immediately behind each of the pistons. The front compartment is open to the outside air in front of the piston, the middle compartment is open to the outside air through a hole formed in the extreme front end of the compartment, and the rear compartment is connected via a passage to a reversing valve carried on the housing. This reversing valve can feed compressed air either to the space in front of the rear piston so as to pull the three pistons back, or to the space behind the rear piston, thereby also feeding air through the passages to the compartments behind the other two pistons.

In accordance with yet another feature of this invention the control valve is mounted on a collar which is axially and longitudinally nondisplaceable on the housing but rotatable therearound. This control or pilot valve is provided with a longitudinally extending trigger that, when rocked from its normal rest position, can actuate a spool valve so as to operate the riveter. Thus it is possible for the collar carrying the control valve and the trigger on this valve to be arranged at any angle relative to the housing in order that the user may employ that position which is most comfortable for him and not have to worry about the particular position of the feed hose relative to the housing.

According to a further feature of the invention the control valve comprises a reversing spool valve having a spool slidable in a cylinder on the control-valve collar and urged in one direction by a compression spring and displaceable in the opposite direction by compressed air in an end of the cylinder. This compressed air in the end of the cylinder can be released into the atmosphere by rocking of the trigger in order that the spring is effective to displace the valve spool in the opposite direction.

It is also within the scope of the present invention to provide the control valve and trigger rigidly fixed on the housing. In this case the control valve and trigger are secured on the side of the housing corresponding to that side from which the chuck-containing nosepiece projects.

According to a further feature of this invention the long arm of the lever is between one and one-half and three times longer than the short arm invention, preferably twice as long. This lever is of the bell-crank type with its pivot not lying directly between the end of the long arm against which the pistons are effective and the end of the short arm which is connected to the chuck.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
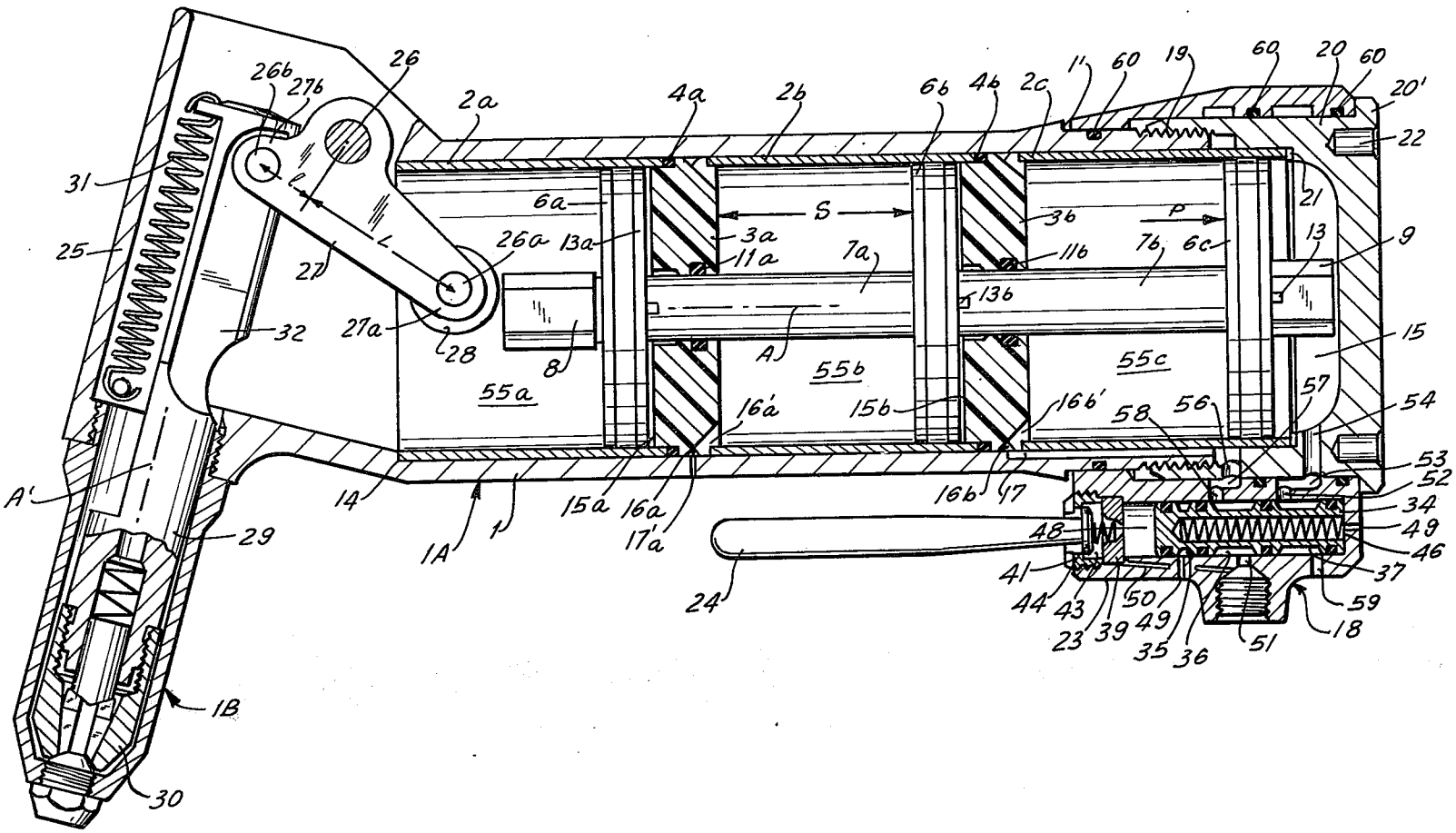
FIGS. 1, 2, and 3 are longitudinal sections through the apparatus according to the present invention in unactuated, partially actuated, and fully actuated positions, respectively.
Figure 2:
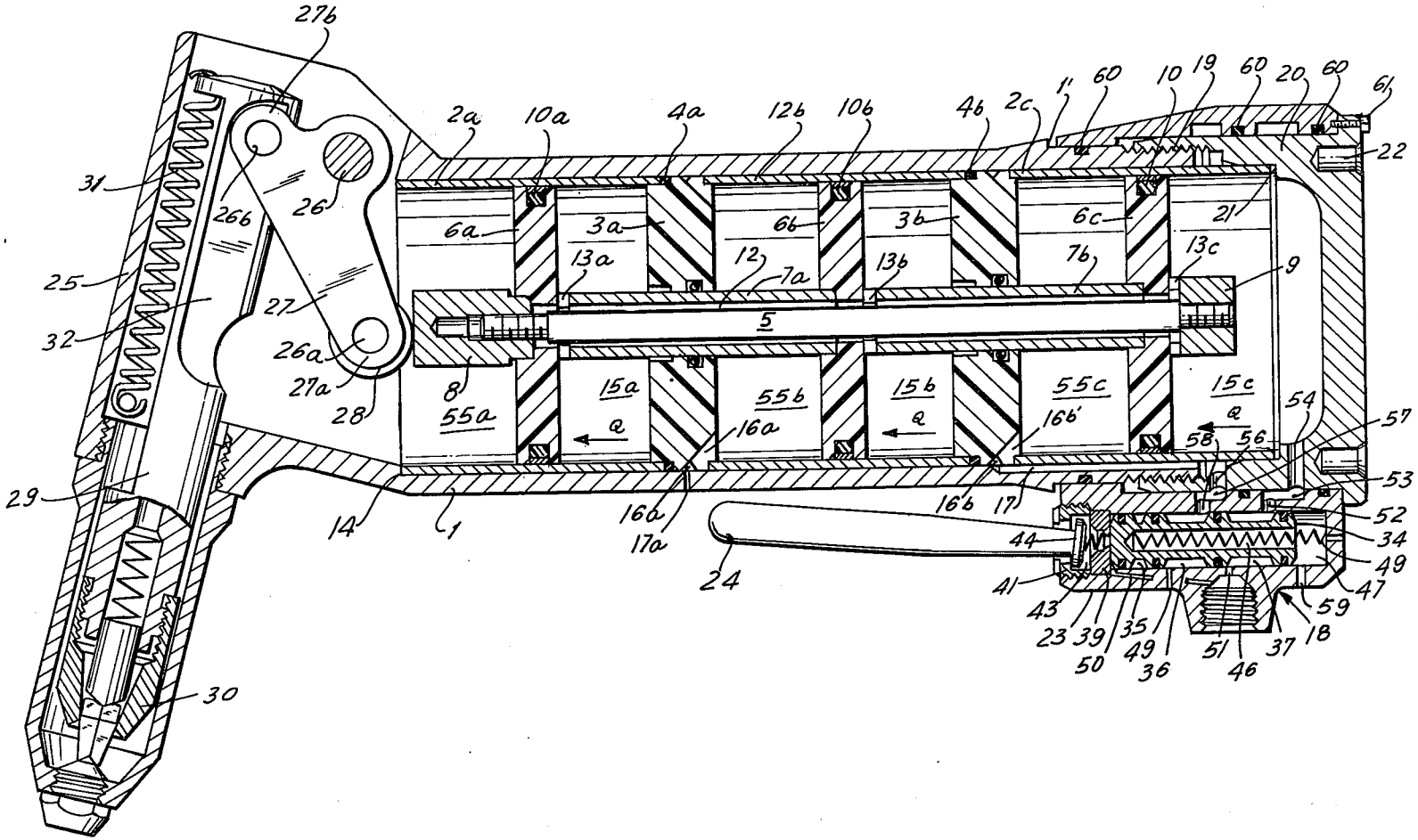
Figure 3:
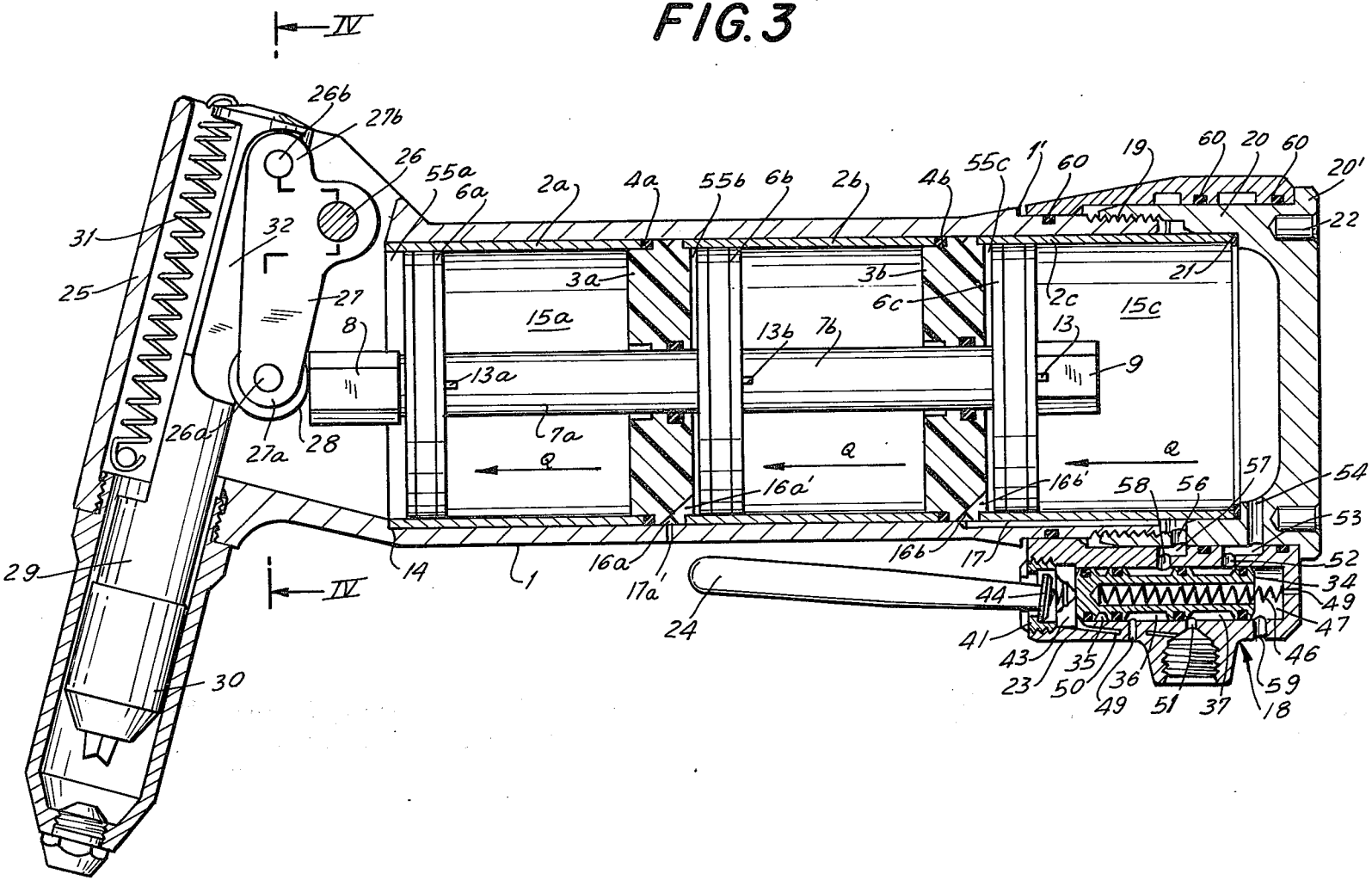

As shown in FIGS. 1–3 the riveter according to the present invention has a housing 1 with a cylindrical handle or body part 1A lying on an axis A and a nosepiece 1B lying on an axis A extending at an angle of approximately 115 to the axis A. This angle has been found particularly comfortable in use. The body 1A of the housing is cylindrical and hollow and provided with a liner formed of three cylindrical tubes **2*a*, 2*b* and 2*c*. Two annular partition disks 3*a* and 3*b*, of the same outside diameter as the tubes 2*a–c*, have O-ring seals 4*a* and 4*b* compressed between the tubes 3*a* and 3*b* and sections 2*a* and 2*b* respectively. The front end of the tube 2*a* bears against a shoulder 14 at the front end of the housing 1 and the rear engages against a shoulder 21 formed in an end cap 20 that is threaded at 19 to the rear end of the housing body 1A. Diametrically opposite holes 22 are provided in the rear face of this cap 20** for its attachment and removal by means of a pin-type key.

The nosepiece 1B of the housing 1 is provided with a mandrel-gripping chuck 30 of conventional design. The housing part 1B has a closed front wall 25 and an open top. A tension spring 31 is secured between the top end of the puller body 29 and the housing 1 so as to pull this body 29 down into the position shown in FIG. 1.

Three annular and disk pistons **6*a*, 6*b*, and 6*c* provided with respective seals 10*a*, 10*b*, and 10*c* slidable within the tubes 2*a*, 2*b*, and 2*c*. A square-section rod 5 is threaded at both ends and provided at its front end with a hexagonal nut-like endpiece 8 and its rear end with a hexagonal nut-like endpiece 9. This rod 5 passes through all three pistons 6*a–c* and through two tubes 7*a* and 7*b* of circular section. The tube 7*a* has a front end braced against the rear face of the piston 6*a* and the rear end recessed in the front face of the piston 6*b*. The tube 2*b* has a front end braced against the rear face of the piston 6*b* and a rear end recessed in the front face of the piston 6*c*. The tubes 7*a* and 7*b* are formed at their front ends with diametrically opposite notches 13*a* and 13*b*, respectively, and the front face of the rear end piece 9 is formed with similar notches 13*c*. In this manner a passage 12 is formed which opens at 13*a* immediately behind the piston 6*a* at 13*b* and immediately behind piston 6*b* at 13*c* immediately behind the piston 6*b*. The chambers 15*a*, 15*b*, and 15*c* are therefore in fluid communication with one another, as best is shown in FIG. 2**.

The stem formed by the tubes **7*a* and 7*b* and the rod 5 is sealed at the partitions 3*a* and 3*b* by O-rings 11*a* and 11*b*. The partitions 3*a* and 3*b* are formed with respective circumferential grooves 16*a* and 16*b* and with backwardly open notches 16*a* and 16*b*, respectively, which place the chambers 55*b* and 55*c* in front of the pistons 6*b* and 6*c* in communication with these grooves 16*b*. In addition the housing 1 is formed with a small orifice 17*a* at the groove 16*a* so that the chamber 55*b* is in communication with the atmosphere. The chamber 55*a* in front of the piston 6*a* is in communication with the atmosphere through the open front end of the housing 1**.

Figure 6:
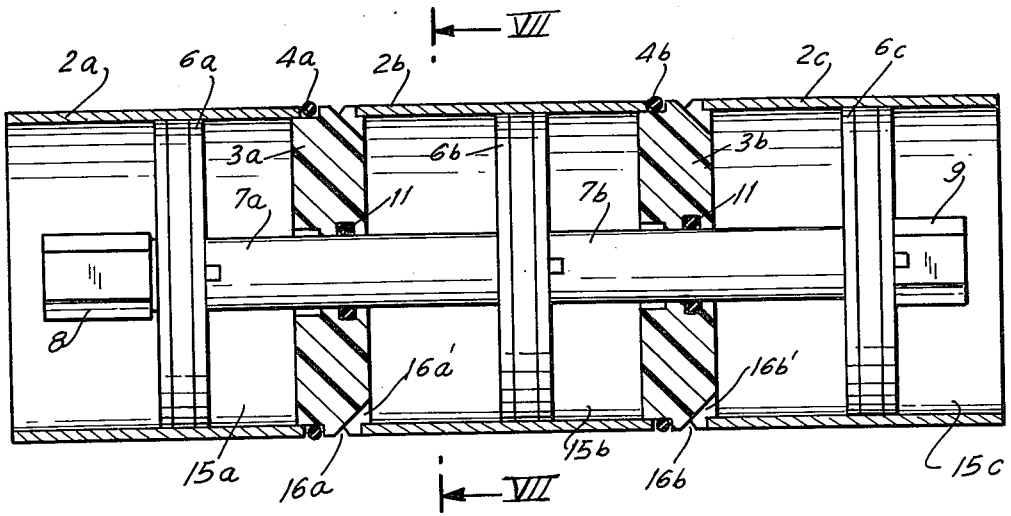
FIG. 6 is a longitudinal section through the liner unit of the riveter shown in FIGS. 1–5.
Figure 7:
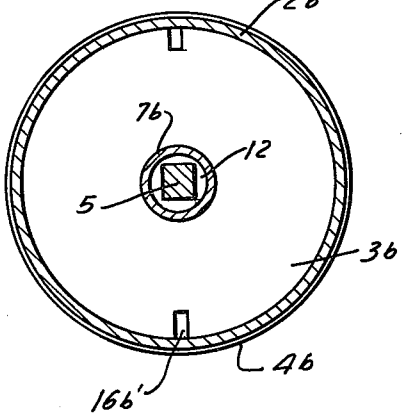
FIG. 7 is a section taken along line VII—VII of FIG. 6.

As shown in FIGS. 6 and 7 this assembly comprising the tube sections **2*a–c*, partitions 3*a* and 3*b* with their associated seals, the pistons 6*a–6c* with their associated seals and the stem 5–9 can readily be replaced. The tube sections 2*a–c* are made of steel as is the entire stem 5–9. The pistons 6*a*–6*c*, partition walls 3*a* and 3*b* are made of a hard synthetic resin, a polyamide such as nylon being very advantageous. The seals 3*a–3c* and 4*a–b* are made of a rugged elastomer. This entire assembly can readily be replaced in the housing 1 which is made of aluminum. After much wear, when the pistons 6*a–6c* begin to leak, it is possible simply to remove the end cap 20 and pull out the entire assembly as shown in FIG. 6**, and then replace it with a new assembly. In this manner that part of the tool which wears most rapidly can be replaced so as fully to renew the tool.

Figure 4:
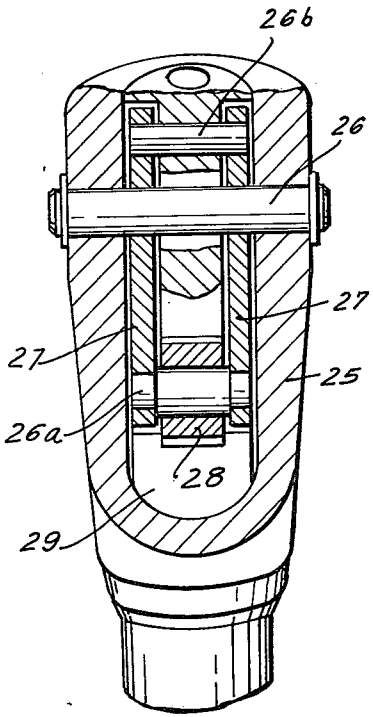
FIG. 4 is a section taken along the line IV—IV of FIG. 3.

The front end of the endpiece 8 bears on a roller 28 carried on a pivot pin **26*a* extending as shown in FIG. 4 between long arms 27*a* of two bell crank-type levers 27 of T-shape. A pivot 26 extending through the front part 25 of the housing acts as a fulcrum for the levers 27 which also have short arms 27*b* between which extends a pin 26*b* that passes through the puller body 29 at the chuck 30. This puller body 29 is cut out at 32 so that as shown in FIG. 3 the lever 27** can swing into it.

At the back end of the housing there is provided a collar 23 constituting the housing for a control valve 18 provided with a trigger 24 extending parallel to the axis A. This collar housing 23 is rotatable on the housing 1 about the axis A but is prevented from being displaced axially thereon by a shoulder 1 formed on the housing 1 and another shoulder 20 formed on the end cap 20. The housing 1 is formed with a longitudinal groove 17 constituting a passage terminating at one end at the circumferential grooves **16*b* in the partition 3*b* and extending all the way to the back end of the housing part 1A. The cap 20 is formed with a pair of radially throughgoing holes 56 and 54 respectively opening at the rear end of the threaded region 19 and at the very rear end of the chamber 15*d***.

Figure 5:
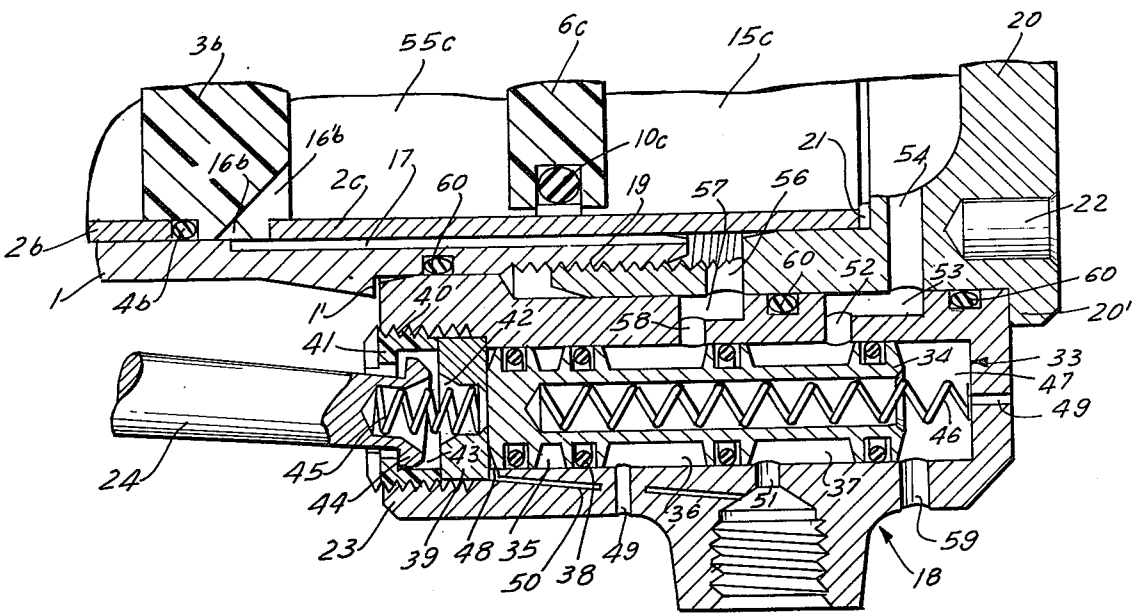
FIG. 5 is a large-scale view of a detail of FIG. 3.

As better shown in FIG. 5 the collar or ring 23 is sealed by O-rings 60 in front of, in back of, and between the holes 56 and 54. In addition the ring 23 is formed with circumferential inwardly open grooves 57 and 53 respectively registering with the holes 56 and 54. This ring 23 is formed with a cylinder 33 subdivided by a spool 34 having O-rings 38 into five longitudinally spaced compartments 48, 35, 36, 37, and 47. Radial holes 58 and 52 extend between the compartments 36 and 37 and the grooves 57 and 53. A compressed air inlet 51 can, depending on the position of valve body 34, open into either chamber 36 or 37. An outlet 59 can also, depending on the position of the valve body 34, open into the compartment 47 or the compartment 37, the compartment 47 always being vented through a small-diameter outlet 49. In addition another vent 49 can open either into the annular compartment 36 or the compartment 35. A passage 50 of very small diameter extends from the compressed-air inlet 51 to the extreme left-hand end of the chamber 48. In addition a compression spring 46 has one end braced against the extreme right-hand end of the cylinder 33 and another end braced against the valve body 34 so as to urge it in a direction that minimizes the volume of chamber 48 and maximizes the volume of chamber 47.

The left-hand end of the cylinders 33 is defined by an annular disk 39 formed with a central opening 42. A ring 40 is screwed into the collar 23 and serves to secure the disk 39 tightly in place. A compression spring 45 is braced between this disk 39 and the handle 24 so as to hold it in a position parallel to the axis A as shown in FIG. 1. The handle 24 has at its rear end an outwardly extending synthetic-resin flange 44 that engages with an inwardly extending lip 41 of the ring 40. When not deflected from the normal position shown in FIG. 1 the handle 24 therefore lies snugly against the ring 40 and prevents air flow out of the chamber 48.

The apparatus functions as follows:

When, as shown in FIG. 1, the handle 24 is parallel to the axis A and compressed air is fed into the inlet 51 there will be a small flow of air through the fine passage 50 into the end chamber 48. As pressure builds up in this chamber 48 the valve body 34 will be pushed to the right as shown in FIG. 3. When all the way into this actuated position the chamber 35 is vented to the atmosphere via opening 49. The compressed air-inlet 51 is connected through passage 36 to hole 58, thence through groove 57 and hole 56 to the passage 17 opening into the chamber **55*c* in front of the piston 6*c*. Pressure buildup in the chamber 55*c* is effective in the direction of arrow P on the piston 6*c* so as to displace it back until its endpiece 9 comes into contact with the inside of the cap 20. This action fully retracts the pistons 6*a*–6*c* and the spring 25 then pulls the lever 27 into the position illustrated in FIG. 1**.

In order to set a rivet the mandrel is forced into the self-locking chuck 30, the rivet is inserted into the workpiece, and the handle 24 is actuated as shown in FIG. 2.

Actuation of the handle 24 allows air from the chamber 48 to escape so that the spring 46 pushes the spool 34 to the left as shown in FIGS. 2 and 5. When the spool 31 is all the way to the left the compressed air in the chamber **55*c* can bleed out through the notches 16*b*', the groove 16*b*, the passage 17, and the hole 56, the groove 57, the hole 58, the chamber 36, and the vent hole 49. At the same time air is fed into the chambers 15*a*–*c* via the passage 37, the hole 52, the groove 53, the hole 54, and thence passes into the chambers 15*a* and 15*b* via the notches 13*c*, the passage 12, and the notches 13*a* and 13*b*. In this manner pressure builds up behind all three of the pistons 6*a*–6*c* so it can move them forwardly in the direction of arrows Q. Air in the chamber 55*a* is forced out through the notches 16*a*', the groove 16*a* and the vent hole 17*a*' and the air in the space 55*a* in front of the piston 6*a* simply is forced out through the front of the housing. As the pistons 6*a*–6*c* move forward the stem 5–9 similarly moves forward so that endpiece 8 presses on the roller 28 and pivots the levers 27. The mechanical advantage gained by the 2:1 difference in length L and 1 of the arm 27*a* and 27*b* is thus effective on the puller body 29 which is forced up against the extensions of springs 31 so as to upset the rivet held in the chuck 30. The pistons 6*a*–6*c* move forward until the pistons 6*b* and 6*c* virtually rest against the back face of the partitions 3*a* and 3*b*, thereby obtaining a relatively long stroke S and exerting considerable force on the rivet via the chuck 30. The cross-sectional size of the passage 50 is very small compared to the cross-sectional size of the outlet or vent opening created by rocking of the lever 24 so that pressure cannot build up in the compartment 48**.

After the rivet is set the trigger 24 is allowed to rock back to the position shown in FIG. 1. The chamber 48 is again pressurized through the passage 50 and the spool 34 is moved back to the right against the force of spring 46. When all the way in the right-hand or actuated position the spool 34 again allows air to flow via the passage 17 into the chamber **55*c* in front of the piston 6*c*. At the same time air in the chamber 15*c*, and in the chambers 15*a* and 15*b* in fluid communication therewith can bleed out through the radial hole 54, the groove 53, the hole 52, the chamber 37, and the vent hole 59. Thus the spring 31 need not also serve to return the cascaded pistons 6*a*–*c*** to their starting position.

The device according to the present invention is extremely easy to use and has a very long service life. The user can comfortably grasp the cylindrical body 1B of the housing and actuate the trigger 24 with ease. The hose connected to the inlet orifice 51 can be allowed to run off at any angle, as the collar 23 readily rotates about the housing. It is possible, of course, to provide a screw as illustrated at 61 so as to fix the collar 23 relative to the housing in case it should be desired to maintain it in this single position. The angle of the nosepiece 1A relative to the rest of the housing has also been found extremely comfortable as it allows the user of the tool to press down on the rivet being inserted and to fit it into relatively tight spaces if necessary. Should the tool wear out it is possible to install a new liner unit as shown in FIGS. 6 and 7 in a few minutes so as to fully renew and replace virtually all of those parts of the device which are likely to wear out.

We claim:

1. A blind riveter comprising:

a housing having a front end and an opposite rear end and formed with an elongated chamber extending between said ends;

at least one piston longitudinally displaceable in said chamber;

a rivet-gripping chuck at said front end displaceable generally transversely to said chamber;

a pivot at said front end of said housing;

a lever pivotal on said pivot and having a relatively long arm extending from said pivot and having an outer end operatively engageable with said piston and a relatively short arm having an outer end engageable with said chuck, whereby a mechanical advantage effective on said chuck is gained by pivoting of said lever with said piston; and means for pressurizing said chamber behind said piston and thereby displacing same toward said front end to pivot said lever and transversely displace said chuck, said means including a collar longitudinally fixed but rotatable on said housing, and a control valve mounted on said collar operable to feed compressed air to said compartment through said collar.

2. The riveter defined in claim 1 wherein said control valve includes a cylinder, a spool displaceable in said cylinder between an actuated position and a rest position, a spring urging said spool into said rest position, and means including a trigger operable for pushing said spool into said actuated position.

3. The riveter defined in claim 2 wherein said collar has an inner periphery formed with at least one circumferential inwardly open groove, said housing being formed with a radial passage between the rear end of said chamber and the outer surface of said housing at said groove.

4. The riveter defined in claim 2 wherein said valve includes means for feeding air to said chamber in front of said piston absent operation of said trigger to retract said piston.

5. The riveter defined in claim 2 wherein said trigger is longitudinally elongated and rockable from a normal position, said valve means including a pilot valve connected between a source of compressed air and said cylinder and operable on rocking of said trigger from said normal position.

6. The riveter defined in claim 5 wherein said cylinder has one end provided with said spring and another end formed as a fluid compartment, said valve having a small-diameter passage extending between said source and said other end of said cylinder and means for opening said other end up to the outside on rocking of said trigger from said normal position.

7. A blind riveter comprising:

a housing having a front end and an opposite rear end and formed with an elongated chamber extending between said ends;

at least one piston longitudinally displaceable in said chamber;

a rivet-gripping chuck at said front end displaceable generally transversely to said chamber;

a pivot at said front end of said housing;

a lever pivotal on said pivot and having a relatively long arm extending from said pivot and having an outer end operatively engageable with said piston and a relatively short arm having an outer end engageable with said chuck, whereby a mechanical advantage effective on said chuck is gained by pivoting of said lever with said piston;

means for pressurizing said chamber behind said piston and thereby displacing same toward said front end to pivot said lever and transversely displace said chuck;

two partitions subdividing said chamber into a front compartment, a rear compartment, and a middle compartment between said front and rear compartments, one such piston being provided in each compartment; and a stem interconnecting said pistons for joint longitudinal displacement thereof, said stem extending longitudinally between said pistons through said partitions and being formed with a passage opening immediately behind each piston, the extreme front ends of two of said compartments being vented to the atmosphere and said means for pressurizing being connected to the extreme front end of the unvented compartment.

8. A blind riveter comprising:

a housing having a front end and an opposite rear end and formed with an elongated chamber extending between said ends;

at least one piston longitudinally displaceable in said chamber;

a rivet-gripping chuck at said front end displaceable generally transversely to said chamber;

a pivot at said front end of said housing;

a lever pivotal on said pivot and having a relatively long arm extending from said pivot and having an outer end operatively engageable with said piston and a relatively short arm having an outer end engageable with said chuck, whereby a mechanical advantage effective on said chuck is gained by pivoting of said lever with said piston; and means for pressurizing said chamber behind said piston and thereby displacing same toward said front end to pivot said lever and transversely displace said chuck, said long arm having provided at its free end with a roller, said piston having an endpiece engageable with said roller, said riveter further having spring means for urging said roller against said endpiece and thereby pressing said piston back in said housing.

9. The riveter defined in claim 8 wherein said spring means includes a spring having one end secured to said housing and another end to said lever.

10. In a pneumatic-mechanical blind riveting apparatus having a piston system driven by compressed air under the control of a manually operable lever acting upon a compressed air controlling valve, in which the piston system has a piston rod which actuates a chuck for the shank of a blind rivet, the chuck being displaceable in the housing of the riveter by a double-arm lever fulcrumed in this housing and acted upon by the piston rod at one arm and acting with its other arm upon the chuck, the improvement wherein:

the housing is openable to enable withdrawal of the piston system as a unit therefrom and said piston system, withdrawable as a unit from said housing, comprises a plurality of axially spaced aligned pistons mounted on said piston rod, said piston rod having a projecting free end upon the forwardmost of said pistons bearing freely against the first mentioned arm of the lever, and respective cylinder sections slidably receiving each of said pistons and in mutual axial alignment, said sections being separated by partitions traversed by said rod, said first mentioned arm of said lever being formed with a roller engaging the projecting portion of said rod.

11. The improvement defined in claim 10 wherein said double arm lever is swingably mounted in said housing on a pivot and has a relatively long arm extending from said pivot and engageable by said piston rod and a relatively short arm extending from said pivot and engageable with said chuck, said relatively long arm being said first-mentioned arm, said housing being formed with an elongated chamber separated by said partitions into respective compartments each containing one such piston, said housing being provided with means serving to pressurize said compartments behind the respective pistons.

12. The improvement defined in claim 11 wherein said long arm is substantially twice as long as said short arm.

13. The improvement defined in claim 11 wherein said pistons have an end face on said rod engageable with said roller.

14. The improvement defined in claim 11 wherein the portion of said rod traversing said partitions forms a stem, said stem being provided with a passage having one end opening immediately behind one of the pistons into the respective compartment and another end opening immediately behind the other piston in its respective compartment whereby fluid communication is effected between said compartments through said stem, said improvement further comprising sealing means surrounding the stem where it traverses a respective partition.

15. The improvement defined in claim 14 wherein said stem is formed of a round-section tube surrounding a core rod and having a front end engaging the back of a piston in a forward one of said compartments and a rear end engaging the front of a piston in a rearward one of said compartments, said core rod being of polygonal section in said tube and extending forwardly beyond and through the piston in said forward compartment and backwardly beyond and through the piston in said rearward compartment, and a pair of end pieces on the ends of said core rod clamping said pistons against the ends of said tube, said one end of said passage being formed at the rear end piece and the other end of said passage being formed at the forward end of said tube, said passage being formed between said core rod and said tube.

16. The improvement defined in claim 15, further comprising means for clamping said cylinder sections tightly in place.

17. The improvement defined in claim 16 wherein said partitions are of substantially the same outside diameters as said cylinder sections and are clamped between ends of said cylinder sections.

* * * * *